US009867484B2

(12) United States Patent
Hudson

(10) Patent No.: US 9,867,484 B2
(45) Date of Patent: Jan. 16, 2018

(54) PILLOW CURLER CASE

(71) Applicant: Toni Joanne Hudson, Corpus Christi, TX (US)

(72) Inventor: Toni Joanne Hudson, Corpus Christi, TX (US)

( * ) Notice: Subject to any disclaimer, the term of this patent is extended or adjusted under 35 U.S.C. 154(b) by 0 days.

(21) Appl. No.: 14/920,608

(22) Filed: Oct. 22, 2015

(65) Prior Publication Data

US 2017/0112298 A1 Apr. 27, 2017

(51) Int. Cl.
*A47G 9/02* (2006.01)
*A47G 9/10* (2006.01)

(52) U.S. Cl.
CPC ..... *A47G 9/02* (2013.01); *A47G 9/0253* (2013.01); *A47G 9/10* (2013.01); *A47G 9/1045* (2013.01)

(58) Field of Classification Search
CPC ..... A47G 9/02; A47G 9/1045; A47G 9/0253; A47G 9/10
See application file for complete search history.

(56) References Cited

U.S. PATENT DOCUMENTS 3,604,026 A * 9/1971 Scheips ..... A47C 7/383 297/397
4,274,673 A * 6/1981 Kifferstein ..... A47C 7/383 297/220
4,754,513 A 7/1988 Rinz
5,084,928 A * 2/1992 Skillington ..... A47G 9/0253 5/482
5,271,114 A * 12/1993 Kjersem ..... A47G 9/0253 5/490
7,089,617 B1 * 8/2006 Lauro ..... A47G 9/10 5/490
8,572,779 B2 * 11/2013 Pratt ..... A47G 9/0253 5/636
2006/0112487 A1 * 6/2006 Taylor ..... A47G 9/0253 5/490
2008/0086818 A1 4/2008 Sramek
2012/0227185 A1 * 9/2012 Batiste ..... A47G 9/007 5/641
2013/0227784 A1 * 9/2013 Holliday ..... A47G 9/0253 5/490

* cited by examiner

*Primary Examiner* — David E Sosnowski
*Assistant Examiner* — Morgan J McClure
(74) *Attorney, Agent, or Firm* — M. Susan Spiering; Ferrell's PLLC

(57) ABSTRACT

Disclosed herein, is a pillow curler case, also called a pillow cover having a specialty panel that is used in conjunction with a traditional pillow. When the pillow is placed in the cover, an indentation is formed allowing the user to place their head in the indented region of the pillow while having their neck and shoulders supported by the edges of the pillow. This indentation provides for greater comfort when lying on the pillow, in particular when wearing hair or head devices or where there is a desire for separation between a user's face and their pillow. Other applications will be apparent to those of skill in the art for uses of the final rolled pillow which is formed.

8 Claims, 3 Drawing Sheets

PILLOW CURLER CASE

CROSS REFERENCE TO RELATED APPLICATION(S)

None

BACKGROUND

Field of the Invention

The present invention relates to a pillow that provides comfort to a user while sleeping by giving appropriate neck support. More particularly, the present invention relates to a pillow cover that is designed to accommodate the pillow such that the user can sleep comfortably, for example, when hair devices are attached to his hair and/or when the user desires a separation between the face and the pillow.

Description of the Related Art

Various types of pillows and pillow covers have been known in the art that provide comfort to a user while sleeping. Generally pillow covers or pillow cases (the words cover and case are interchangeable here) are used primarily for covering a pillow and allowing a barrier from the user and surface of the pillow. However, not many covers are intended to mold the pillow in a particular format. Some orthopedic pillows have been designed that are molded, and provide appropriate support to the neck so as to prevent headache, stiffness and pain in the back, shoulder, and arms. Pillows are developed for dissipating body heat, or having a particular shape to allow a body to hold it easily between a user's legs. Generally, these pillows are considered specialty items and are available in one-piece, they are not suitable for all users as they do not always match with the user requirements; e.g., the preferences of the softness of pillows vary across different users, or the type of support they provide vary with the shape of the pillow.

Specialty pillows such as orthopedic pillows can be expensive and require additional accessories such as special pillow cases.

Individuals who wear head gear can find it difficult to sleep on a standard pillow. Head gear is defined herein as items useful for covering your head, for example for protection of your mouth/teeth, head injury wrappings or equipment, or the wearing of hair accessories such as rollers or curlers. Many a time, the user while sleeping or taking a power nap prefers that his hair is not disturbed. Specifically, hair devices like curlers and the like do not allow the user to sleep comfortably on a standard or currently available pillow. Moreover, the placement of curlers present on the head gets disturbed because of the existing pillows. Women and girls generally tend to frequently change their hairstyle which follows with fashion trends for various events and occasions. The use of various hair devices like curlers, rollers and the like is not uncommon to be worn or used during a sleep period. Generally it takes a couple of hours or more for these hair devices to set the hair as per the desired hairstyle. It becomes cumbersome for women to sit upright for a long period of time and hence they prefer to sleep till the desired hairstyle is achieved. However, it becomes uncomfortable to sleep with these devices on and also while sleeping, the placement and positioning of the hair device is disturbed.

US publication No. 2008/0086818 by Roger A. Sramek, David E. Lovejoy and Roger S. Smith discloses a pillow comprising variable displacement parameters that support a head of a reclining body in a comfortable and ideal sleeping position. U.S. Pat. No. 4,754,513 by Gustave R. Rinz discloses a pillow cover and removable insert for converting a conventional pillow into an orthopedic pillow. Though the aforementioned disclosures provide a pillow and a pillow cover respectively that provide neck support for head and body comfort, they fail to provide comfort to the user in the presence of hair devices and/or comfort of a pillow which allows separation between the face and the pillow itself.

In light of the foregoing discussion, there exists a need for an innovative pillow cover that not only provides neck support to the user but also provides comfort while using various hair devices and also provides comfort while separating the face from the pillow.

SUMMARY

An object of the present invention is to provide a pillow cover for accommodating a traditional, standard size pillow that protects the user's hairstyle, when desired; and providing comfort while sleeping with hair devices attached to one's hair. It can also be used by anyone having head devices or head gear on one's head while sleeping on or with a standard pillow. Additionally, the invention provides a cave between both ends of the pillow, allowing facial separation from the pillow. It can also be used as a body rest for arms and or legs, or to support a person's back while they are seated.

In an embodiment of the present invention, the pillow cover includes an opening present at both ends along its width. This can be used for inserting the pillow and it also allows the user to insert their hands through both ends for additional comfort while sleeping. Alternatively, the pillow cover has an opening at only one end, which can be used for inserting the pillow and a hand, when desired. The total surface area of the pillow cover is less than the total surface area of most traditional pillows. A front surface of the pillow cover on which a user rests his head includes elastomeric edges. Since the elastomeric edges have a tendency to contract, and since the area of the pillow cover is less than that of the pillow, the pillow is curled, forming a hollow space therein.

A panel is provided along the front surface that covers the formed hollow space. The panel covers an area equivalent to an area covered by an indentation. Hence, when the pillow is inserted inside the pillow cover, the border formed between the edges of the pillow cover and the panel is rolled outwardly to form the indentation along the front surface. The indentation superimposes with the hollow space formed by the pillow.

The panel is designed to minimize the discomfort caused while sleeping due to the presence of hair devices and/or to create a space between the user and the pillow.

BRIEF DESCRIPTION OF DRAWINGS

The features of the present invention, which are believed to be novel, are set forth with particularity in the appended claims. Embodiments of the present invention will hereinafter be described in conjunction with the appended drawings provided to illustrate and not to limit the scope of the claims, wherein like designations denote like elements, and in which:

DETAILED DESCRIPTION OF EMBODIMENTS

Figure 1:
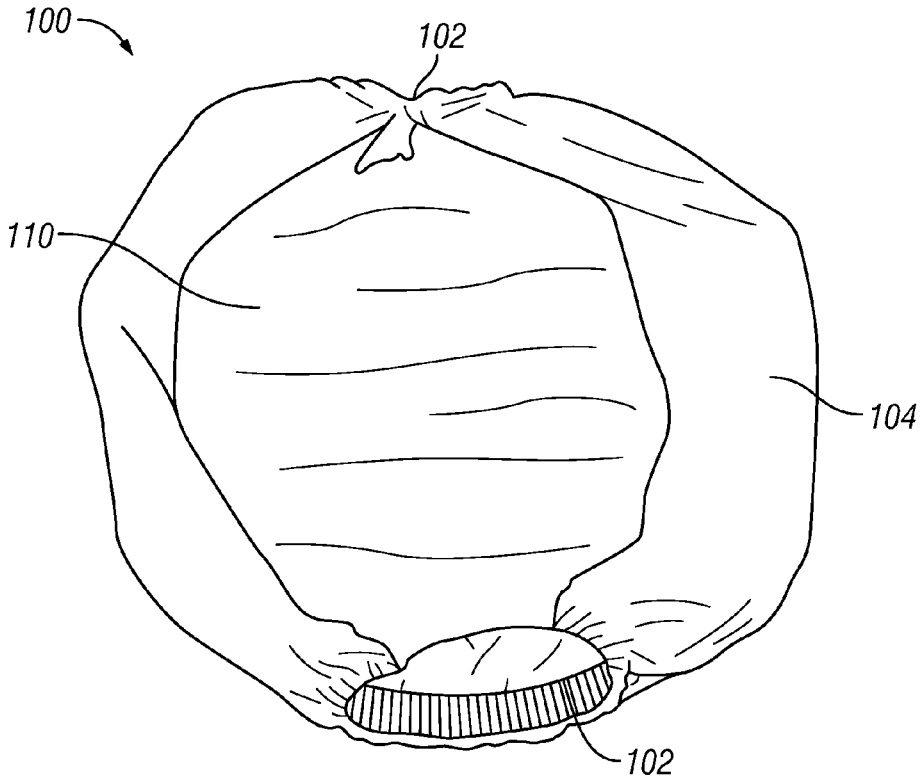
FIG. 1 shows a perspective view of a pillow cover without the presence of a pillow.

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention.

There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of system components which constitutes a pillow cover used for achieving comfortable sleeping conditions in presence of hair devices on one's hair and providing a separation between the face and pillow. Accordingly, the components and the method steps have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Disclosed herein is a pillow cover for accommodating a pillow and forming an indention comprising a generally rectangular shaped pillow case smaller than a pillow to be inserted therein, having at least one opening but alternatively a first and second opening on each end thereof and means to close the opening, wherein the opening is sufficiently large for insertion and removal of at least one pillow; a front side and a rear side of the case, wherein the front side contains a panel comprising about one third to about one quarter (⅓ to ¼) of the total space of the pillow cover, such that when the pillow is inserted into the cover, at least one edge along the panel buttresses an edge of the pillow panel causing the pillow to curl and form an indentation, the depth of which is at least about ⅓ the size of the pillow. The pillow cover and panel can be made of a variety of fabrics such as satin, cotton, flannel, winceyette, nylon, velvet, polyester and linen and the like. The resulting rolled pillow having a defined indentation can be used by a person wearing hair curlers or other appliances while they sleep or used by those needing additional support during rest.

A pillow cover 100 designed to be used by a user for sleeping with a set of hair devices (not shown) attached to his hair is shown in FIG. 1 according to an embodiment of the present invention and is also designed to produce a cavity between the user and pillow to protect the face from pillow marks.

The pillow cover 100 not only provides neck support to the user but also provides comfort when the hair devices are attached on the user's head.

The pillow cover 100 minimizes discomfort caused while sleeping with a set of hair or head devices and creates a comfortable sleeping condition for the user. The set of head devices may include hair rollers, hair curlers, hair clippers, and hair crimpers or medical head gear or ear gear or the like. The pillow and pillow cover 100 of the present invention are intended to be used with such hair devices; however, they can be used without the hair devices, wherein the user seeks a comfortable sleeping posture, or when a traditional pillow is required to be used as an orthopedic pillow. The indented pillow can also be used as a leg or arm rest (i.e., body rest) or a back support while sitting up on a chair or bed mattress.

The pillow cover 100 includes an opening 102 for inserting and removing a pillow, such as a traditional pillow. Alternatively, other insertions for the pillow may be used; such as side seams along the edge of a panel. To close the seam, i.e. zippers, buttons, Velcro, etc. can be used in the body of the invention. The point being is to have an opening to insert a rolled pillow, and form a dent.

In a preferred embodiment of the present invention, the opening 102 is on both ends present along the width of the pillow cover 100. In an alternative embodiment, the opening 102 may be provided on one end only. The pillow cover 100 is intended to be used with a traditional standard sized pillow. However, it should be appreciated that the pillow of any dimension can be accommodated inside the pillow cover 100 by appropriately designing the pillow cover 100.

The pillow cover 100 has a front side 104 and a rear side (not shown). The user attempts to sleep with his head always occupying the front side 104 of the pillow cover 100. Edges 106 are formed between the front side 104 and the rear side (not shown) of the pillow cover 100. The edges 106 define an area therebetween on the front side 104, onto which indentations 108 are formed.

The edges 102 are made of an elastomeric material, such as rubber. It should be appreciated that any polymeric material that exhibits good stretch ability and elastic properties can be used as the elastomeric material.

Figure 2:
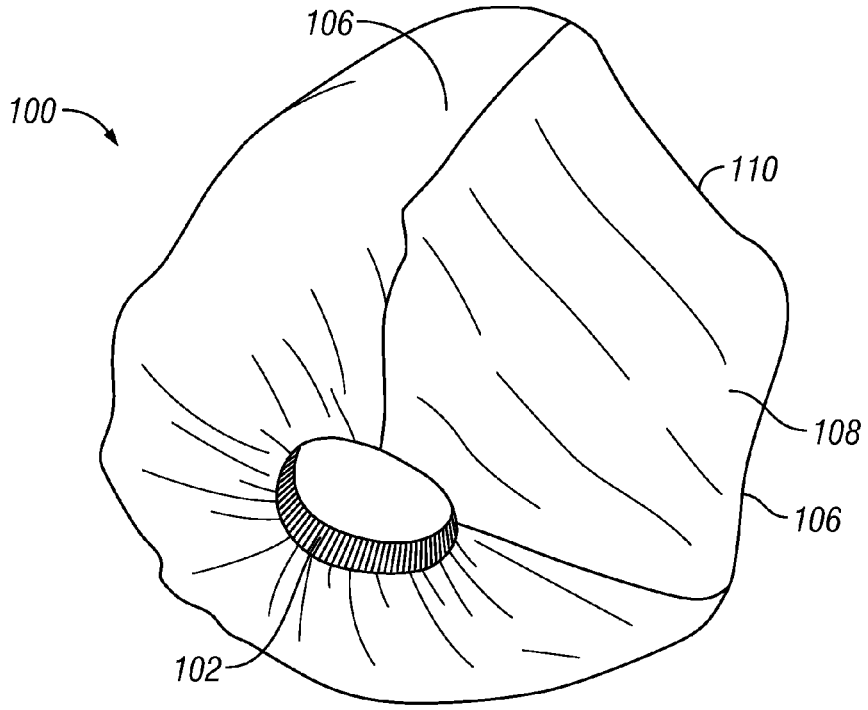
FIG. 2 shows a perspective view of the pillow cover with the presence of the pillow.

The pillow cover 100 is designed in such a way that total surface area of the pillow is always greater than total surface area occupied by the pillow cover 100. As a result, when the pillow is placed inside the pillow cover 100, the front side 104 forms a concave surface in the form of an indentation 108 as shown in FIG. 2.

As the total surface area of the pillow is more than the total surface area of the pillow cover 100, the plurality of edges 106 bends outwardly to form the indentation 108. In other words, the pillow is curled inside the pillow cover 100, when viewed from a side position, as shown in FIG. 2.

The size of the pillow cover 100 plays a significant role in the formation of the indentation 108. If the size of the pillow cover 100 is greater than desired, the pillow will be folded in half inside the pillow cover 100 failing to form an appropriate indentation 108. Similarly, a considerably smaller size of the pillow cover 100 will force the pillow to form a roll and not the indentation 108. Hence, the pillow cover 100 of appropriate dimension should be used that will enable the formation of the indentation 108. The pillow cover 100 should be of sufficient size that the rolled up pillow forms a dent and not a roll, or alternatively folds in effect to half its size and does not form a defined dent. Neither of the later two options are the intent of the subject invention.

A panel 110 is present on the indentation 108 such that the area covered by the indentation 108 coincides with the area covered by the panel 110.

In an embodiment of the present invention, the panel 110 occupies about one-fourth to one-third of the total area that is covered by the front side 104 of a standard size pillow, having either one of soft, medium and/or firm foam. While foam is a preferred pillow interior, feathers or other pillow internal material can be used.

The panel 110 covers a central area of the front side 104 of the pillow cover 100. As the openings as shown in the figures are of an elastomeric material, they shrink, thereby making the panel 110 appear tapered towards the openings 102.

The panel 110 provides a visual indication, or a marker, to the user for appropriately placing the pillow inside the pillow cover 100 such that a front face of the pillow lies below the panel 110 at all times thereby facilitating the formation of the indentation 108. The panel 110 also contributes to the formation of the indentation through use of the elasticized ends, and the edges or seams thereof.

According to an embodiment of the present invention, when using a standard size US (United States) pillow inserted in the case, the width of the panel 110 is about 9 inches, tapering at the gathered ends. At the elastomeric openings 102, the width of the panel 110 is about 5 inches with the pillow inserted in the case. The following dimensions are considered for pillows and pillow cases for forming ideal indentations:

| Pillow (inches) | Pillow Case/Panel (for indentation) (inches) |
|---|---|
| 20 × 28 (super standard) | 27/13 |
| 20 × 30 (standard jumbo) | 31.5/12.5 |

The ideal length for a pillow case was found to be about 25 inches long for a standard jumbo (US term) pillow or about 22 inches long for a super standard (US term) pillow.

In another embodiment, the panel 110 can range from about 9.5 to 13.5 inches, however this range will vary based on the size of the pillow to be used. In an example, the dimensions of the sleeping pillow can range from about 27 to 44 inches long while the dimensions of the panel 110 can range from about 9.5 to 13.5 inches wide.

In an embodiment the maximum width of the pillow cover 100 without a pillow inside, i.e., including the edges and the panel (or when the pillow cover is completely stretched) at the center of the front side is at least about 18 inches. The distance measured between the opening 102 present at both ends of the pillow cover 100 (i.e., the overall length of the pillow cover 100) is about 20-22 inches; however, it may be longer. Hence, to form the indentation 108, the dimensions of the pillow need to be greater than the dimensions of the pillow case cover 100.

It should be appreciated that any standard US pillow can be used with the pillow cover 100 to form the indentation 108. The dimensions are provided for a standard US pillow, but these can be altered proportionally to a different size pillow.

To use the cover, the pillow is rolled along its length and inserted into the pillow cover 100 through the openings 102 or a side seam and zipper, such that the roll enters with the pillow edges first.

After inserting, the pillow is unrolled inside the pillow cover 100 so that it forms the desired indentation 108 on the pillow which is reflected on the panel 110.

Figure 4:
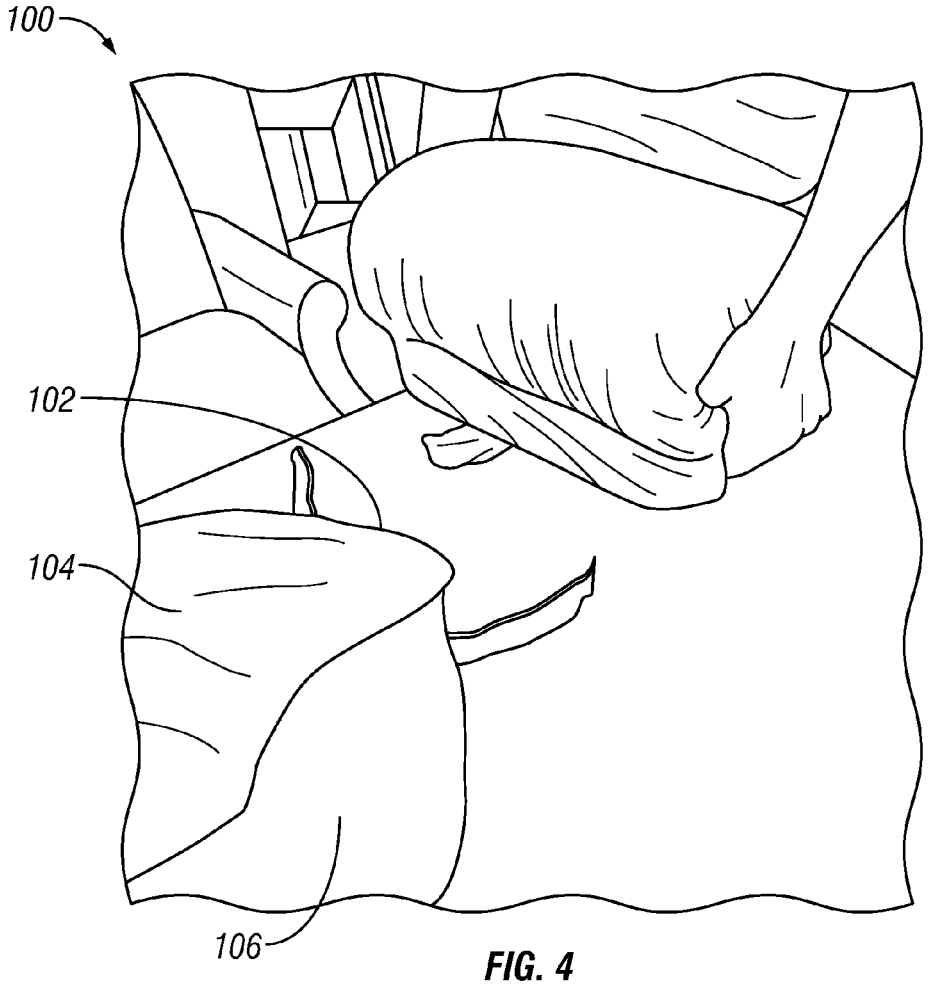
FIG. 4 shows a perspective view of the pillow cover along with a rolled pillow.
Figure 5:
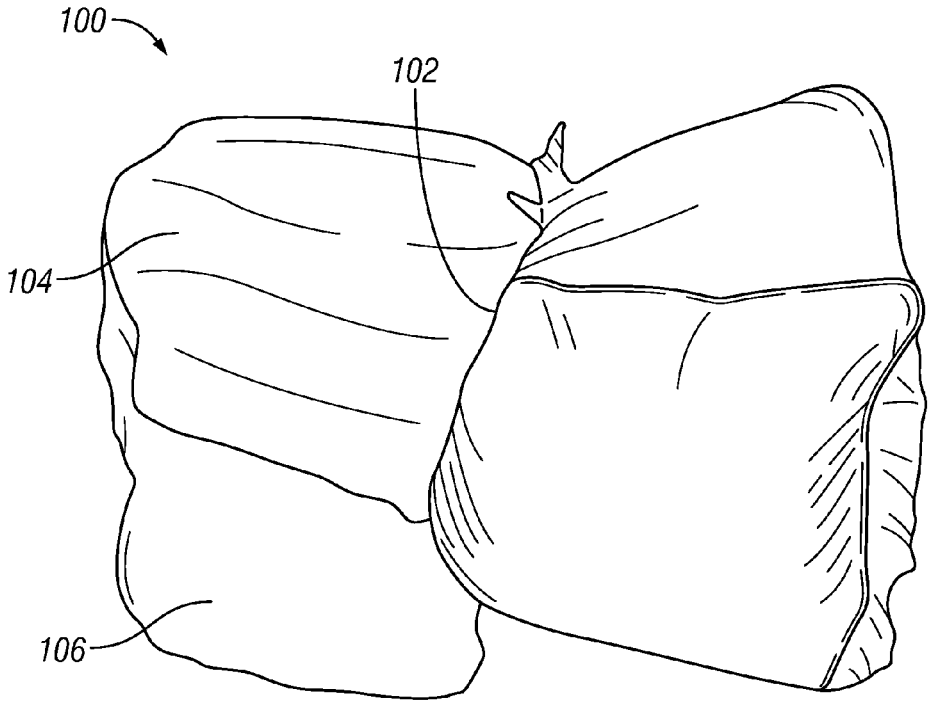
FIG. 5 shows a perspective view of the pillow cover while inserting of the rolled pillow.
Figure 6:
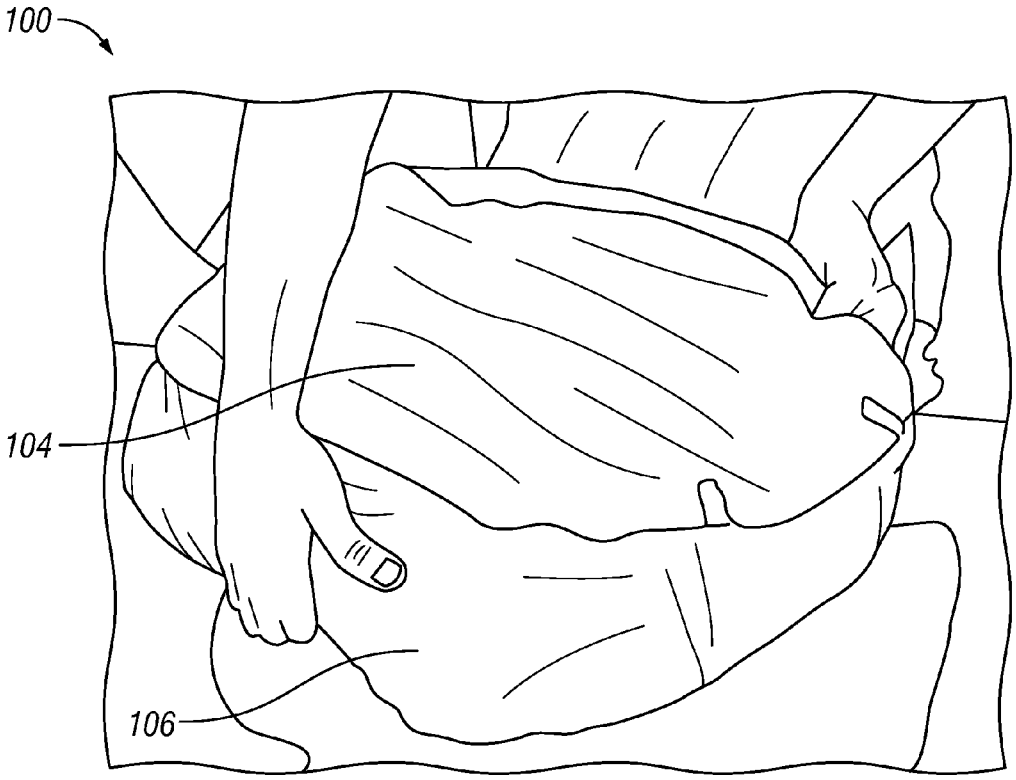
FIG. 6 shows a perspective view of the pillow cover with the presence of the rolled pillow and a user adjusting the sides.

FIGS. 4, 5 and 6 show a user rolling a pillow lengthwise and inserting the pillow in the pillow cover 100 through the opening 102. The user adjusts the pillow inside the pillow cover 100 having the edges of the pillow along or near the edges of the panel, thereby positioning the pillow at the center of the pillow cover 100, and forming a dent. A soft or medium padding on the pillow forms a softer indentation 108 whereas a firm padding on the pillow forms a harder indentation 108. However, the type and size of the pillow can vary depending on the user's desired comfort.

The formation of an indentation 108 is affected by the cushioning or thickness of the pillow. If the panel 110 is narrow, the indentation 108 formed is small. However, the small indentation 108 an still provide desired comfort to a person. Moreover, a bigger indentation 108 is likely preferred on the pillow when a user wears large curlers on their hair. If they just want to keep their face off the pillow, a smaller indentation 108 is likely suitable. When the pillow cover 100 with the pillow is used as a back rest or leg rest/holder, a smaller indentation 108 is suitable. The design of the pillow cover 100 helps to manipulate a pillow for various uses in an inexpensive manner.

In an example, a pillow is folded, inserted, and accommodated in the pillow cover 100 through the opening 102 to form a dent. The formed indentation 108 on the top surface 104 allows a person with hair accessories such as rollers or curlers to comfortably place the head in the indentation 108. The design of the pillow cover 110 does not disturb the hair or head pieces, or the hairstyle of the person and moreover allows the person to rest or sleep without damage to their hairstyles.

Figure 3:
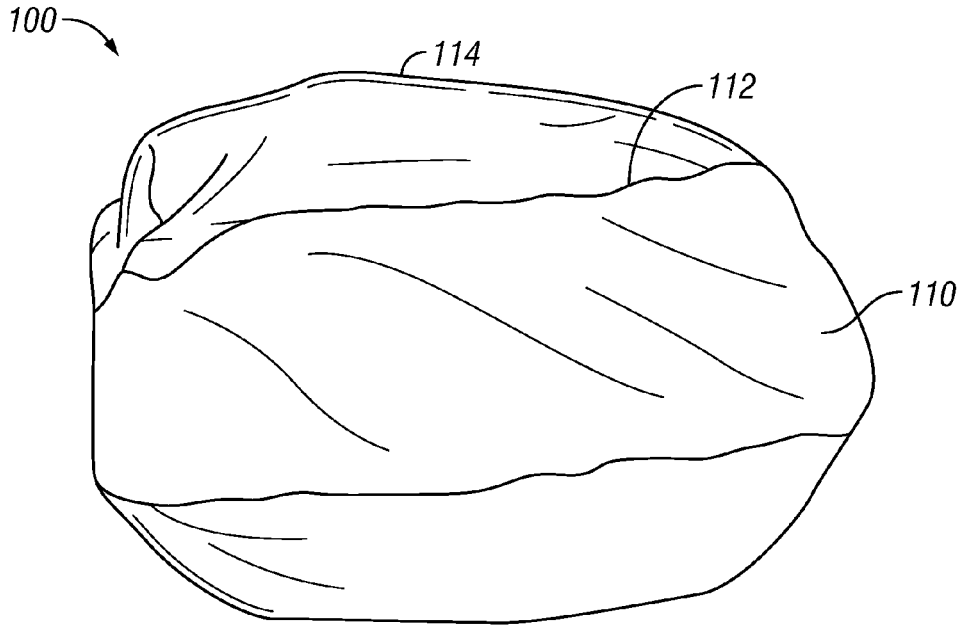
FIG. 3 shows a perspective view of the pillow cover positioned inside-out.

It has been found that the indentation 108 is formed when the pillow is positioned within the pillow cover 100 such that the edges of the pillow are abutting the edges of the panel 110. In an embodiment of the present invention, the panel includes a seam 112 on an inner side 114 of the pillow cover 100. The seam 112 on the inner side 114 of the pillow cover 100 can be seen when the pillow cover 100 is folded inside-out as shown in FIG. 3. The seam 112 defines a region of adherence of the panel 110 to the pillow cover 100. On this seam maybe closure means such as zipper, buttons, or velco.

The pillow cover 100 can be made of a variety of soft fabrics including satin, cotton, flannel, winceyette, nylon, velvet, polyester and linen. Alternatively, the fabric can also be of a disposable type material particularly useful in germ-centered or germ-concerned areas such as a hospital setting, or the like. It should be appreciated that any other material used for manufacturing the pillow cover 100 is well within the scope of the invention.

The panel 110 can be made from the same fabric as the remainder of the pillow or it can be made from any other suitable material. The panel 110 and the pillow cover 100 can both be made of elastomeric (or stretch) fabric, or of a non-stretch fabric, or a mixture of either. The choice of fabric is per the user's discretion, but the chosen fabric should be easy to maintain, clean, and use.

The present invention has been described herein with reference to a particular embodiment for a particular application. Although selected embodiments have been illustrated and described in detail, it may be understood that various substitutions and alterations are possible. Those having ordinary skill in the art and access to the present teachings may recognize additional various substitutions and alterations are also possible without departing from the spirit and scope of the present invention, and as defined by the following claim.

What is claimed is:

1. A pillow cover that accommodates a pillow for allowing a person's head with a headgear to rest therein, the pillow cover comprising:

a rectangular shaped pillow case having a front side, a rear side, and at least one circular opening formed on an end thereof, wherein length and width of the rectangular shaped pillow case are less than length and width of the pillow, respectively; and a panel of quadrilateral shape attached to the front side of the rectangular shaped pillow case, wherein the width of the panel is less than the width of the rectangular shaped pillow case, and wherein the panel occupies about ⅓ to ¼ of total space of the rectangular shaped pillow case, and wherein, in a first configuration, when the pillow is not inserted in the pillow cover, the pillow cover is substantially flat, and in a second configuration, when the pillow is inserted into the pillow cover, edges of the panel buttress edges of the pillow that are present along the edges of the panel, thereby causing the edges of the pillow to bend outwardly, the pillow to curl, and the front side of the pillow case to form a concave surface in the form of an indentation that allows the person's head with the headgear to rest on the pillow.

2. The pillow cover of claim 1, wherein the rear side of the pillow cover is made of at least one of satin, cotton, flannel, winceyette, nylon, velvet, polyester, and linen.

3. The pillow cover of claim 1 wherein the panel is made of at least one of satin, cotton, flannel, winceyette, nylon, velvet, polyester and linen.

4. The pillow cover of claim 1, wherein the head gear comprises at least one of hair curlers and hair rollers.

5. The pillow cover of claim 1 further comprising means for closing the at least one circular opening, wherein the means to close the at least one circular opening comprises an elastomeric material.

6. The pillow cover of claim 1, wherein the at least one circular opening includes a first and second circular openings at corresponding ends of the pillow cover.

7. The pillow cover of claim 1, wherein the at least one circular opening for the panel includes an edging alongside a panel seam.

8. The pillow case of claim 7, wherein the at least one circular opening is closed with one of a zipper, button, and a hook and loop fastener.

* * * * *